United States Patent [19]

Samuelson

[11] Patent Number: 4,850,847

[45] Date of Patent: Jul. 25, 1989

[54] SPINNERET FOR HOLLOW FIBERS HAVING CURVED SPACING MEMBERS PROJECTING THEREFROM

[75] Inventor: Harry V. Samuelson, Chadds Ford, Pa.

[73] Assignee: E. I. Du Pont de Nemours and Company, Wilmington, Del.

[21] Appl. No.: 192,413

[22] Filed: May 10, 1988

[51] Int. Cl.[4] ..... D01D 5/24

[52] U.S. Cl. ..... 425/382.2; 264/177.13; 264/177.14; 425/464

[58] Field of Search ..... 264/177.13, 177.14; 425/461, 382.2

[56] References Cited

U.S. PATENT DOCUMENTS

| | | | |
|---|---|---|---|
| 3,558,420 | 1/1971 | Opfell | 264/177.14 |
| 3,585,684 | 12/1966 | McIntosh | 425/464 |
| 3,772,137 | 11/1973 | Tolliver | 425/382.2 |
| 4,325,765 | 4/1982 | Yu et al. | 156/167 |
| 4,385,886 | 5/1983 | Samuelson | 425/464 |
| 4,483,903 | 11/1984 | Reinehr et al. | 428/373 |
| 4,648,830 | 3/1987 | Peterson et al. | 425/464 |

FOREIGN PATENT DOCUMENTS

| | | | |
|---|---|---|---|
| 43-523 | 1/1968 | Japan | 264/177.13 |
| 44-899 | 1/1969 | Japan | 264/177.14 |
| 56-101905 | 8/1981 | Japan | 264/177.13 |
| 60-182948 | 8/1985 | Japan . | |
| 61-44022 | 3/1986 | Japan . | |
| 61-46329 | 3/1986 | Japan . | |
| 631566 | 11/1978 | U.S.S.R. | 264/177.13 |

OTHER PUBLICATIONS

Klare et al., "Synthetic Fibers from Polyamides, Technology and Chemistry", Akademie-Verlag, Berlin (1963).

Chang et al., "Glucose Oxidation in a Dual Hollow Fiber Bioreactor with a Silicone Tube Oxygenator", Biotechnology and Bioengineering, vol. XXIX, pp. 552-557 (1987).

Murakami, "Hollow Fiber Membranes for New Biotechnology", 42, No. 6, pp. 243-248 (1986).

*Primary Examiner*—Jay H. Woo

*Assistant Examiner*—Khanh P. Nguyen

[57] ABSTRACT

A hollow fiber with a plurality of members projecting from its outer surface in an arc turned back on itself is formed from a spinneret having a segmented orifice wherein each segment comprises a first portion in the form of an arc curved about the center of the orifice, a second portion extending from the first and connected to a third portion which is in the form of a reverse curve with respect to the first.

5 Claims, 4 Drawing Sheets

SPINNERET FOR HOLLOW FIBERS HAVING CURVED SPACING MEMBERS PROJECTING THEREFROM

CROSS-REFERENCE TO OTHER APPLICATION

The following application of common assignee contains some common disclosure and is believed to have an effective filing date identical with that of the present application:

HOLLOW FILAMENT WITHIN A HOLLOW FILAMENT COMPOSITE FIBER HAVING SPACING MEANS AND A SPINNERET FOR PRODUCTION THEREOF Ser. No. 07/193710

BACKGROUND OF THE INVENTION

This invention relates to hollow fibers and, more particularly, it relates to hollow fibers having projections from their surfaces and spinnerets for the production thereof.

Hollow fibers having projections from their surface have been previously disclosed for use in membrane-type artificial kidneys and plasma separators. These projections act to maintain a distance between adjacent hollow fibers present in a bundle. This optimizes the fiber surface area available for fluids or other substrates passing between the fibers. These fibers also have utility in the textile industry for insulation or batting purposes. Maintaining a distance between adjacent fibers can provide added loft and insulation potential when used in a textile application.

SUMMARY OF THE INVENTION

This invention provides hollow fibers having a plurality of members projecting from the surface thereof in an arc of variable length, including the continuation of the members back upon themselves to a second location on the fiber surface to a result in a hollow fiber having an additional hollow structure at its surface.

A spinneret for the production of the fibers of this invention includes a plate having upper and lower surfaces connected by a capillary, the capillary comprises an orifice having a plurality of segments, each segment comprising a first portion curved about the center of the capillary orifice, a second portion extending in a straight line to the first portion, and a third portion extending from the second portion initially in a reverse curve direction with respect to the first portion.

DETAILED DESCRIPTION OF THE ILLUSTRATED EMBODIMENTS

This invention provides new hollow fibers having spacing members projecting from the surface thereof and spinnerets for their production.

The spacing members of the fibers project from the surface of the fiber in an arc of variable length. By varying the length of the arc, curved spacing members of varying length can be achieved, including the continuation of the member to a second location on the fiber surface, resulting in a hollow fiber having an additional hollow structure at its surface.

A spinneret for the production of the fibers of this invention includes a plate having upper and lower surfaces connected by a capillary, the capillary orifice in the lower surface comprises a plurality of segments, each segment comprising a first portion in the form of an arc curved with respect to the center of the capillary orifice, a second portion extending in a straight line from the first portion, and a third portion extending from the second portion initially in a reverse curve direction with respect to the first portion.

Figure 1:
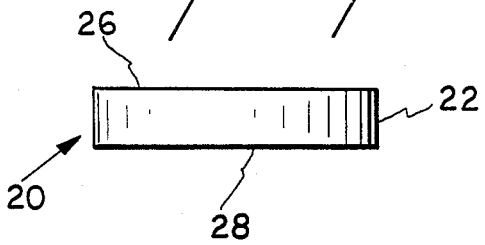
FIG. 1 is a side elevation view of a spinneret plate useful to produce the fibers of this invention.
Figure 2:
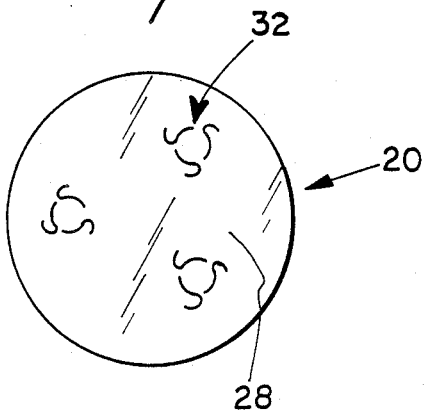
FIG. 2 is a plan view of the lower surface or face of the spinneret of FIG. 1 showing one arrangement for the capillary orifices of the spinneret.
Figure 3:
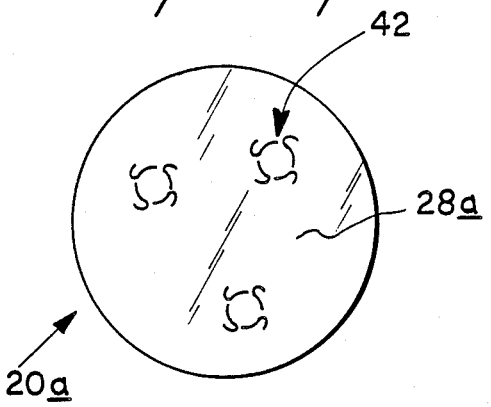
FIG. 3 is a plan view of the lower surface or face of the spinneret of FIG. 1 showing another arrangement for the capillary orifices of the spinneret.

Referring to FIGS. 1–3, the spinneret 20 comprises a plate 22 having upper and lower surfaces 26, 28, respectively, connected by at least one capillary defined by an orifice in the lower surface of the plate through which molten polymer is extruded. A three-segment orifice 32 in lower surface 28 is shown in FIG. 2 and a four segment orifice 42 in lower surface **28*a* is shown in FIG. 3**.

Figure 4:
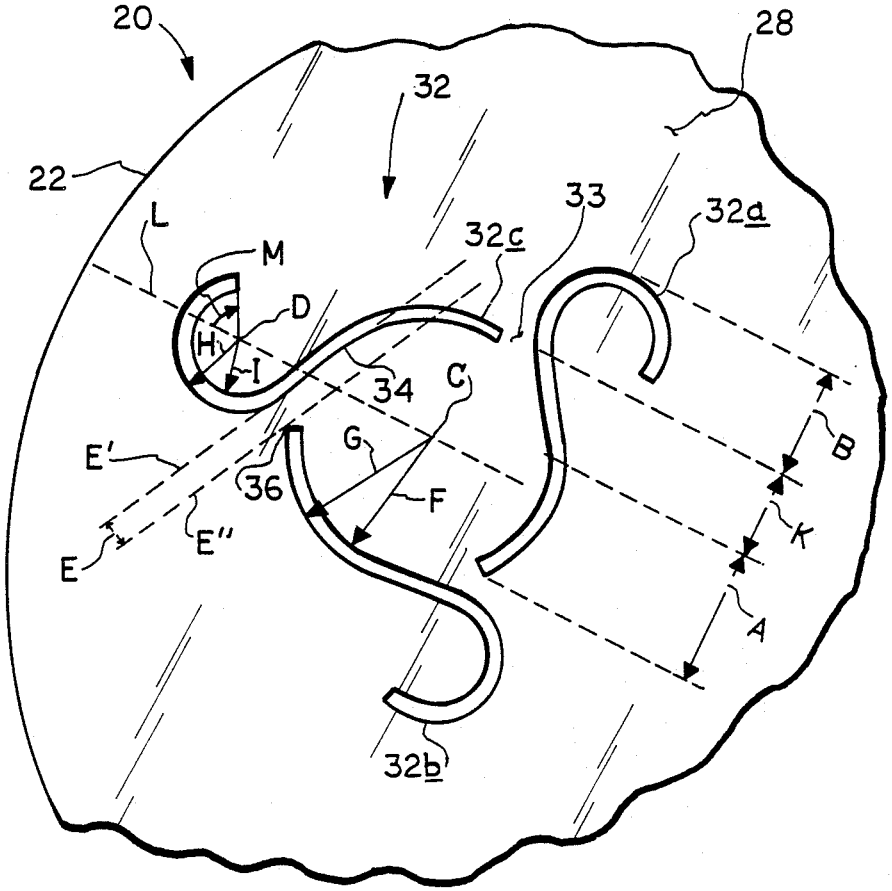
FIG. 4 is an enlarged view of a portion of FIG. 2 showing one orifice and the spatial relationship of the segments of the orifice.

FIG. 4 shows a spinneret orifice 32 through which polymer will be extruded to form the hollow fibers of this proposal. Orifice 32 comprises three independent segments **32*a*, 32*b*, 32*c* separated by bridges 33. The segments comprise a first portion A in the form of an arc curved about the center C of the orifice 32**, a second portion K extending in straight line from the first portion, and a third portion B extending from the second portion initially in a reverse curve direction with respect to the first portion.

Orifice 32 is constructed in a spinneret face by selecting a center point C for the orifice and a center point D for each of the segments to be formed; creating first portions A having an inner edge radius F and outer edge radius G from center point C; forming reverse curve portion B as arcs having inner edge radius I and outer edge radius H from center point D; and connecting portions A and B with a second portion in the form of straight portion K. The second portion K will preferably be tangential on one edge to the inner arc of portion A and to the outer arc of third portion B and will also be tangential on its outer edge to the outer edge of portion A and the inner edge of portion B. For radius length F, G, H, I, the difference in length between G and F will be equal to the difference in length between H and I. Additionally, if a line L is drawn through center points C and D, then the distance along line L from C to D will preferably be about equal to the length of H plus G where the length of G is preferably greater than or equal to the length of H. Segment B extends around center point D to a point defined with respect to line L. Segment B can be extended to meet line L or made shorter or longer which will then result in fibers formed therefrom having shorter or longer spacing members, respectively, from the surface thereof. If segment B is continued as arc M 60° past line L, a hollowshaped spacing member may be formed on the surface of a fiber.

Bridges 33 separate the segments of orifice 32 and provide structural integrity to the inner section of the orifice. The length E of bridges 33 are defined by the distance between a line E′ extended parallel from the inside edge 34 of a segment of orifice 32 and a second line E″, drawn parallel to edge 34 and through segment corner 36. Typical values for the orifice dimensions are given in the examples.

Figure 6:
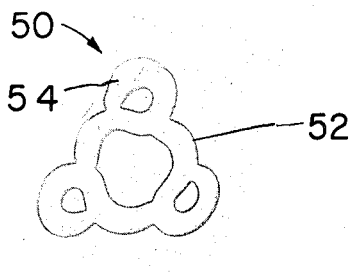
FIG. 6 is an enlarged cross-sectional view of a filament made using a spinneret having a three segment orifice exemplified by FIGS. 2 and 4.

FIG. 6 is a cross-sectional view enlarged to about 250× of a fiber formed by a spinneret orifice as shown in FIG. 4 where arc M is 60° past line L.

Figure 7:
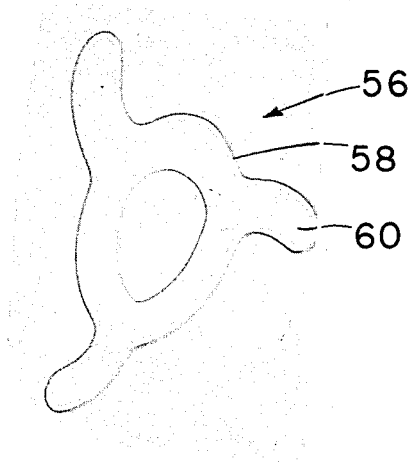
FIG. 7 is an enlarged cross-sectional view of another filament made according to this invention.

FIG. 7 is a cross-sectional view enlarged to about 250× of a fiber formed by the spinneret of FIG. 4 where portion B extends only to line L.

Figure 5:
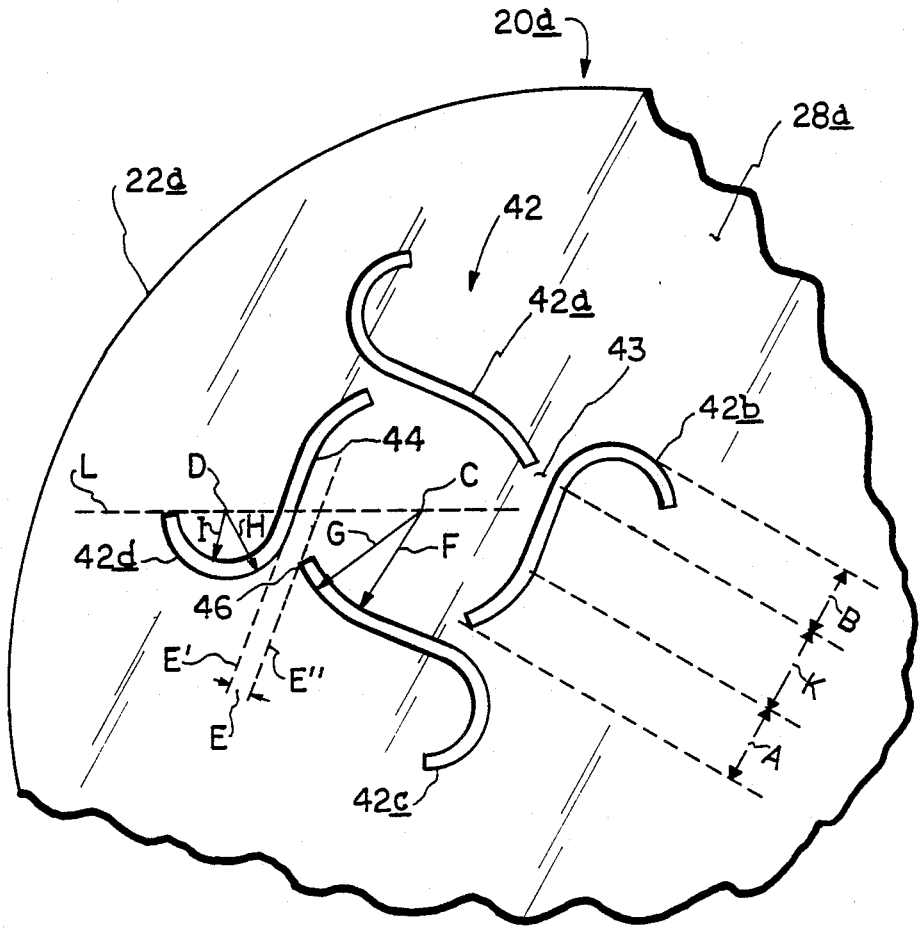
FIG. 5 is an enlarged view of a portion of FIG. 3 showing one orifice and the spatial relationship of the segments of the orifice.

FIG. 5 shows an alternate embodiment of an orifice of this proposal. This orifice 42 contains four segments 42*a*, 42*b*, 42*c*, 42*d* separated by bridges 43. The segment pattern and construction of the orifice of FIGS. 2 and 2A are as described for FIGS. 1 and 1A. The length E of bridges 33 are defined by the distance between a line E′ extended parallel from the inside segment edge 44 of orifice 42 and a second line E″ drawn parallel to edge 44 and through segment corner 46. Radius lengths G, F, H and I have the same relationships and can be of the same dimensions as those given in the examples for FIG. 4.

In operation, a polymer will be melt-extruded through a spinneret orifice of this invention to form a hollow fiber having spacing members projecting in a curved direction from the surface thereof. The length of the spacing members can be controlled by the length of the reverse curve portion B of the orifice segment. Newly extruded fibers are initially discontinuous along their perimeter due to the bridges separating the segments of the orifice; however, coalescence of the polymer occurs immediately following extrusion and results in a fiber having a continuous perimeter. In addition to providing structural integrity to the orifice, the bridges allow for a gas, for example, air, to enter the interior of the hollow fiber as it is extruded, thereby maintaining the shape of the hollow fiber during spinning and preventing collapse of the fiber walls inward.

Depending on the polymer type, quench conditions, and the extension of arc of the reverse curve portion of the orifice segments, the spacing members can project from a first location on the fiber surface in a curved direction to a second location on the fiber surface, thereby forming additional hollow structures at the surface of the fiber. Faster throughputs of polymer through the orifice or decreased quench conditions for the extruded fiber will aid formation of the hollow spacing member structures on the fiber surface. Additionally, extension of segment B in an arc 60° past line L will aid closed projection formation.

EXAMPLES

Example 1

This example describes the spinning of a hollow fiber having curved spacing members projecting from the surface thereof. The spinneret used was a spinneret of the type shown in FIG. 4 and having arced portion B extended by angle M 60° past line L. The spinneret orifice had the following dimensions:

Length G=0.030 inch
Length F=0.0265 inch
Length I=0.0115 inch
Length H=0.015 inch
Length E=0.006 inch
Length C-D=0.045 inch The fibers were spun from polymethylpentene (Mitsui Petrochemicals (America), Ltd., Transparent grade RT 18, melt flow rate=26 g per 10 min, melt point =240° C., density=0.833g/cm$^3$). The polymer was melted in a heated screw melter to a temprature of about 268° C. and then extruded through an orifice which was maintained at a temperature of about 268° C. The polymer was metered at a rate of 1.2 g/min/orifice. After the fibers were extruded, they were quenched with room temperature cross flow air and passed over a contact finish role where a spin finish (10% solution of an alkylstearate ester lubricant emulsified with Aerosol® OT and Merpole® 1452) was applied to effect cohesion in the multi-fiber bundle. The fibers were then brought together using convergence guides and wound up onto a bobbin at 200 mpm. The fiber was cut into thin sections and examined under light microscopy at a magnification of about 250× and found to have the structure as shown in FIG. 6. The fiber 50 had curved spacing members 54 in contact at two locations on the outer surface 52 and projecting therefrom.

Example 2

This example describes the spinning of an alternate embodiment of the fibers of this proposal. The spinneret used was of the type shown in FIG. 4 and had the same dimensions as described for Example 1 except that the curved portion B was extended only to line L. The polymer type was as described in Example 1 and was melted in a heated screw melter to a temperature of about 275° C. and extruded through an orifice which was maintained at about 275° C. The polymer was metered at a rate of 1.2 g/min/orifice.

After the fibers were extruded, they were quenched with room temperature cross-flow air and passed over a contact finish roll where a spin finish (a 10% solution of an alkylstearate ester lubricant emulsified with Aerosol® OT and Merpol® 1452) was applied to effect cohesion in the multi-fiber bundle. The fibers were then brought together using convergence guides and wound up onto a bobbin at 200 mpm. The fibers were cross-sectioned and then examined using light microscopy at a magnification of about 250× and found to contain structures as shown in FIG. 7. The fiber 56 had curved spacing members 60 projecting from the outer surface 58 thereof.

What is claimed is:

1. A spinneret for the production from molten polymer of a hollow filament having a plurality of members projecting from its outer surface comprising: a plate having upper and lower surfaces connected by a capillary, said capillary comprised of a segmented orifice having at least three circumferentially arranged segments, each segment of said orifice comprising a first portion in the form of an arc curved about the center of the orifice, a second portion extending in a straight length from said first portion and connected to a third portion, said third portion being in the form of a reverse curve with respect to said first portion.

2. The spinneret of claim 1 wherein said third portion is curved about a center for said third portion.

3. The spinneret of claim 2 wherein said third portion continues as an arc past a line connecting said orifice center and said third portion center.

4. The spinneret of claim 3 wherein the third portion continues as an arc past said line for about 60 degrees.

5. The spinneret of claims 1, 2, 3 or 4 wherein said second portion extends in a straight length tangent to said first and third portions.

* * * * *